US009171686B2

(12) United States Patent
Alacqua et al.

(10) Patent No.: US 9,171,686 B2
(45) Date of Patent: Oct. 27, 2015

(54) BISTABLE ELECTRIC SWITCH WITH SHAPE MEMORY ACTUATOR

(71) Applicant: SAES GETTERS S.P.A., Lainate (MI) (IT)

(72) Inventors: Stefano Alacqua, Como (IT); Francesco Butera, Como (IT)

(73) Assignee: SAES GETTERS S.P.A., Lainate (MI) (IT)

( * ) Notice: Subject to any disclaimer, the term of this patent is extended or adjusted under 35 U.S.C. 154(b) by 0 days.

(21) Appl. No.: 14/239,665

(22) PCT Filed: Oct. 22, 2012

(86) PCT No.: PCT/IB2012/055794
§ 371 (c)(1),
(2) Date: Feb. 19, 2014

(87) PCT Pub. No.: WO2013/061234
PCT Pub. Date: May 2, 2013

(65) Prior Publication Data

US 2015/0048921 A1 Feb. 19, 2015

(30) Foreign Application Priority Data

Oct. 28, 2011 (IT) ..... MI2011A01974

(51) Int. Cl.
*H01H 71/10* (2006.01)
*H01H 61/01* (2006.01)

(52) U.S. Cl.
CPC ..... *H01H 71/10* (2013.01); *H01H 61/0107* (2013.01); *H01H 2203/008* (2013.01); *H01H 2221/046* (2013.01)

(58) Field of Classification Search
CPC ..... H01H 61/0107; H01H 71/10; H01H 2221/046; H01H 2203/008
USPC ..... 337/123, 131, 140, 382, 395
See application file for complete search history.

(56) References Cited

U.S. PATENT DOCUMENTS

| | | | | |
|---|---|---|---|---|
| 2,667,546 | A * | 1/1954 | Brady | 200/405 |
| 3,634,803 | A * | 1/1972 | Willson et al. | 337/123 |
| 3,725,835 | A * | 4/1973 | Hopkins et al. | 337/140 |
| 3,748,197 | A * | 7/1973 | Willson et al. | 148/563 |

(Continued)

FOREIGN PATENT DOCUMENTS

WO 01/99135 12/2001

OTHER PUBLICATIONS

International Search Report mailed on Feb. 15, 2013 for PCT/IB2012/055794 filed on Oct. 22, 2012 in the name of SAES GETTERS S.P.A.

(Continued)

*Primary Examiner* — Anatoly Vortman
(74) *Attorney, Agent, or Firm* — Steinfl & Bruno LLP

(57) ABSTRACT

A bistable electric switch is described. The switch has as actuators a pair of opposing SMA wires acting on a drive element integral with a snap-action spring so as to toggle the snap-action spring between two stable positions corresponding to two operating positions of the switch, the drive element being shorter than the distance existing between the two opposing SMA wires when one of the SMA wires is contracted and the other SMA wire is uncontracted. The entire force exerted by the activated SMA wire is used to overcome the resistance of the snap-action spring.

5 Claims, 1 Drawing Sheet

(56) References Cited

U.S. PATENT DOCUMENTS

| | | | | |
|---|---|---|---|---|
| 3,846,679 | A * | 11/1974 | Jost et al. | 361/165 |
| 4,544,988 | A | 10/1985 | Hochstein | |
| 4,806,815 | A * | 2/1989 | Honma | 310/307 |
| 5,977,858 | A | 11/1999 | Morgen et al. | |
| 5,990,777 | A | 11/1999 | Whiteman, Jr. | |
| 6,016,096 | A * | 1/2000 | Barnes et al. | 337/123 |
| 6,943,653 | B2 | 9/2005 | Hanke et al. | |
| 7,372,355 | B2 * | 5/2008 | Agronin et al. | 337/126 |
| 7,928,826 | B1 * | 4/2011 | Woychik et al. | 337/140 |
| 8,443,600 | B2 * | 5/2013 | Butera | 60/528 |

OTHER PUBLICATIONS

Written Opinion mailed on Feb. 15, 2013 for PCT/IB2012/055794 filed on Oct. 22, 2012 in the name of SAES GETTERS S.P.A.

* cited by examiner

BISTABLE ELECTRIC SWITCH WITH SHAPE MEMORY ACTUATOR

CROSS REFERENCE TO RELATED APPLICATIONS

The present application is the US national stage of International Patent Application PCT/IB2012/055794 filed on Oct. 22, 2012 which, in turn, claims priority to Italian Patent Application MI2011A001974 filed on Oct. 28, 2011.

TECHNICAL FIELD

The present invention relates to bistable electric switches, and in particular to an electric switch in which the drive element is moved by an actuator that consists of wires made from shape memory alloy (indicated in the following as "SMA", acronym of "Shape Memory Alloy"). Although specific reference is made in the following to wires, it should be noted that what is being said also applies to other similar shapes with a dimension much greater than the other two dimensions which are generally very small, e.g. strips and the like.

BACKGROUND

It is known that the shape memory phenomenon consists in the fact that a mechanical piece made of an alloy that exhibits said phenomenon is capable of transitioning, upon a temperature change, between two shapes that are preset at the time of manufacturing, in a very short time and without intermediate equilibrium positions. A first mode in which the phenomenon may occur is called "one-way" in that the mechanical piece can change shape in a single direction upon the temperature change, e.g. passing from shape A to shape B, whereas the reverse transition from shape B to shape A requires the application of a mechanical force.

On the contrary, in the so-called "two-way" mode both transitions can be caused by temperature changes, this being the case of the application of the present invention. This occurs thanks to the transformation of the micro-crystalline structure of the piece that passes from a type called martensitic, stable at lower temperatures, to a type called austenitic, stable at higher temperatures, and vice versa (M/A and A/M transition).

A SMA wire has to be trained so that it can exhibit its features of shape memory element, and the training process of a SMA wire usually allows to induce in a highly repeatable manner a martensite/austenite (M/A) phase transition when the wire is heated and to induce an austenite/martensite (A/M) phase transition when the wire is cooled. In the M/A transition the wire undergoes a shortening by 3-5% which is recovered when the wire cools down and through the A/M transition returns to its original length.

This characteristic of SMA wires to contract upon heating and then to re-extend upon cooling has been exploited since a long time to obtain actuators that are very simple, compact, reliable and inexpensive. In particular, this type of actuator is used in some bistable electric switches to perform the movement of a drive element from a first stable position to a second stable position and vice versa. It should be noted that the term "drive element" is intended here to have a very generic meaning since it can take countless shapes according to specific manufacturing needs, as long as it is the element whose movement determines the commutation of the switch between two operating positions, i.e. the opening and closing of an electric circuit.

Some examples of this specific application of SMA wires are described in U.S. Pat. Nos. 4,544,988, 5,977,858 and 6,943,653. The several different embodiments illustrated in these patents share the use of a pair of opposing SMA wires to push a drive element between two stable positions. It should be noted that since the small run that can be obtained from the shortening of a SMA wire would be insufficient to cover the entire run between the two stable positions, said SMA wire is used only to move the drive element through a distance sufficient to arrive beyond the dead center of a snap-action spring connected to said drive element and suitable to take it up to the end of the run.

A typical example of a snap-action spring is a leaf spring secured at its ends such that it remains compressed and toggles between two stable symmetrical positions, as illustrated in the above-mentioned patent U.S. Pat. No. 5,977,858. In the present description, reference will be made to a similar arrangement while it is clear that other types of snap-action springs can be used, such as those disclosed in the other patents U.S. Pat. No. 4,544,988 and U.S. Pat. No. 6,943,653.

The above-mentioned known embodiments share the feature of having two SMA wires permanently connected to or in contact with the drive element on which they act, and this implies a double drawback.

In the first place, the SMA wire that is activated (i.e. that is heated to contract) must exert on the drive element a force not only sufficient to overcome the resistance of the spring to make it snap to the other stable position but also sufficient to tension the other SMA wire that is not activated yet is in contact with the drive element. In other words, the force exerted by the activated SMA wire is partially used to tension the other SMA wire that is moved together with the drive element.

Secondarily, the SMA wire that is not activated undergoes however a mechanical stress that over time may cause fatigue problems in the material. As a consequence, at each operating cycle of the switch both SMA wires are stressed: the activated wire for its normal shortening and re-extending cycle and the wire that is not activated for the mechanical stress received through the drive element.

SUMMARY

Therefore the object of the present invention is to provide a bistable electric switch which overcomes the above-mentioned drawbacks.

This object is achieved by means of a bistable electric switch in which the drive element acted on by the SMA wires is shorter than the distance existing between the two opposing SMA wires when one of the SMA wires is contracted and the other SMA wire is uncontracted.

The main advantage of the switch according to the invention stems from the fact that the activated SMA wire uses its entire force only to overcome the resistance of the snap-action spring, since the other SMA wire that is not activated is not in contact with the drive element throughout the whole shortening run of the activated SMA wire. As a result, a same SMA wire can toggle a stronger spring that provides a greater circuit closure force thus assuring a better electric contact and increasing the reliability of the switch.

A second significant advantage of this novel switch resides in the fact that each SMA wire is stressed only by its normal shortening and re-extending cycle upon activation, whereas it substantially does not undergo any mechanical stress when the other SMA wire is activated. As a consequence, the switch is more reliable and its mechanical structure can be optimized taking into account only the loads caused by the effects of the shape memory.

BRIEF DESCRIPTION OF DRAWINGS

These and other advantages and characteristics of the bistable electric switch according to the present invention will be clear to those skilled in the art from the following detailed description of an embodiment thereof, with reference to the annexed drawings wherein.

DETAILED DESCRIPTION

With reference to said figures, there is seen that a bistable electric switch according to the present invention includes as actuators a pair of opposing SMA wires 1, 2 arranged in a rhomb shape and secured to common end pins 3 aligned along an axis A.

Figure 1:
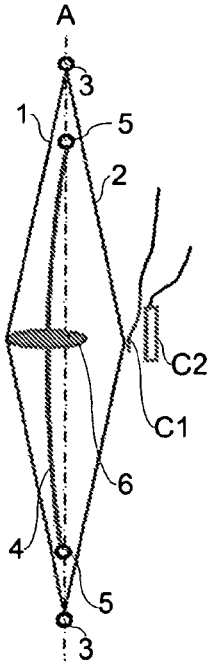
FIG. 1 is a diagrammatic view showing the switch in a first operating position where the electric circuit it controls is open and the snap-action spring is in a first stable position.
Figure 3:
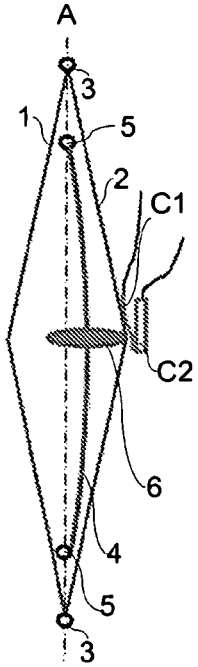
FIG. 3 is a diagrammatic view showing the switch in a second operating position where the electric circuit it controls is closed and the snap-action spring is in said second stable position.

A leaf spring 4, arranged within the rhomb formed by wires 1 and 2, is secured between two end pins 5 also aligned along axis A and located at such a distance that spring 4 is compressed and can only take the two stable positions illustrated in FIGS. 1 and 3.

A drive element 6 is mounted or formed at a central position on spring 4, perpendicularly thereto, such that it can act on a pair of adjacent contacts C1, C2 which represent the electric circuit controlled by the switch.

In the light of the description above, the simple and effective operation of the bistable electric switch according to the present invention is readily understood.

Figure 2:
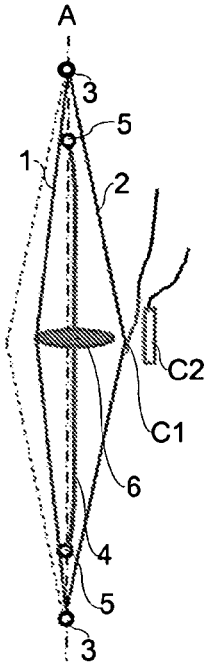
FIG. 2 is a diagrammatic view showing the switch in a transition phase towards the closure of the circuit, at the time when the activated SMA wire has completed its shortening run and the snap-action spring has reached beyond its dead center and is about to snap towards the second stable position.

Starting from the open circuit position of FIG. 1, SMA wire 1 is heated (typically by passing a current through it) so that it contracts and pushes spring 4 towards the second stable position by acting on the drive element 6 integral therewith. In the position of FIG. 2 wire 1 has completed its shortening run, consisting in the difference between its present position in continuous line and its initial position in broken line, and spring 4 has reached beyond its dead center being on the other side of axis A.

The novel aspect of the present switch is that throughout the whole above-mentioned shortening run, wire 1 has pushed only spring 4 through the drive element 6 that has not yet touched the other SMA wire 2 at the time when spring 4 snaps towards the second stable position.

As shown in FIG. 3, when spring 4 reaches said second stable position the electric circuit is closed thanks to the drive element 6 that pushes contact C1, through wire 2, into abutment with contact C2. As soon as the circuit is closed, wire 1 is deactivated such that by cooling down it recovers its original length going back to its initial position thanks to the shape memory effect.

Figure 4:
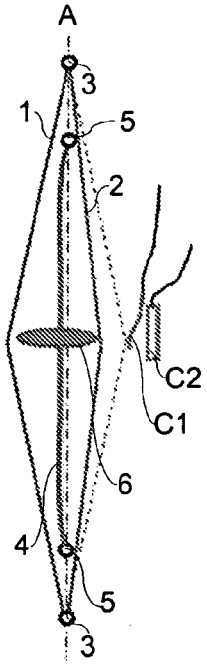
FIG. 4 is a view similar to FIG. 2 where the activated SMA wire has completed its shortening run and the snap-action spring has reached beyond its dead center and is about to snap towards the first stable position.

Finally, the reverse circuit opening operation is illustrated in FIG. 4 that is similar to FIG. 2 and shows the shortening run of wire 2 when it is activated to bring back spring 4 to the first stable position of FIG. 1. Obviously, also in this case wire 2 pushes only spring 4 through the drive element 6, which has not yet touched the other SMA wire 1 at the time when spring 4 snaps towards said first stable position.

It is clear that the above-described and illustrated embodiment of the bistable electric switch according to the invention is just an example susceptible of various modifications. In particular, in addition to the above-mentioned variants, it should be noted that the two opposing SMA wires 1, 2 could also consist of a single wire that is mechanically continuous yet electrically divided into two branches, left 1 and right 2, so as to be able to heat only the branch to be activated.

On the contrary, the two wires 1, 2 could be completely separate and not even share the common end pins 3 as illustrated above, each wire having its own pair of end pins that could even be closer than pins 5 of spring 4 if wires 1, 2 do not form a complete rhomb but only two opposing V's.

Finally, it should be noted that in other embodiments of the snap-action spring and/or of the drive element the closing/opening of the electric circuit (i.e. the commutation of the operating position of the switch) could be carried out in another way rather than directly by the drive element 6 bending contact C1, as long as said closing/opening is caused by the toggling of the snap-action spring between two stable positions under the action of a shape memory actuator.

The invention claimed is:

1. A bistable electric switch comprising a pair of opposing shape memory alloy (SMA) wires acting on a drive element integral with a snap-action spring so as to toggle the snap-action spring between two stable positions corresponding to two operating positions of the switch, wherein:

said drive element is shorter than the distance existing between said opposing SMA wires when one of the SMA wires is contracted and the other SMA wire is uncontracted, and the opposing SMA wires are arranged in a rhomb shape and secured to common end pins aligned along an axis, the snap-action spring being enclosed by said rhomb.

2. The switch according to claim 1, wherein the snap-action spring is a leaf spring secured between two end pins aligned along said axis.

3. The switch according to claim 1, wherein the opposing SMA wires consist of a single wire that is mechanically continuous yet electrically divided into two branches that can be individually heated.

4. The switch according to claim 1, wherein the opposing SMA wires transition between the contracted and uncontracted states upon a change in temperature.

5. The switch according to claim 1, wherein, upon activation of the bistable electric switch, the opposing SMA wires apply a mechanical force entirely to the drive element integral with the snap-action spring.

* * * * *